United States Patent [19]

Heine

[11] 4,040,407

[45] Aug. 9, 1977

[54] INTERNAL COMBUSTION ENGINE DISTRIBUTOR-BREAKER UNIT HOLDING AND ADJUSTMENT ARRANGEMENT

[75] Inventor: Joseph Heine, Vohrenbach, Germany

[73] Assignee: Robert Bosch GmbH, Stuttgart, Germany

[21] Appl. No.: 666,587

[22] Filed: Mar. 15, 1976

[30] Foreign Application Priority Data

May 23, 1975 Germany ..... 2522829

[51] Int. Cl.[2] ..... F02P 5/04; F02P 1/00

[52] U.S. Cl. ..... 123/146.5 A; 74/510; 123/117 R

[58] Field of Search ..... 74/510; 403/373, 256; 123/139 AP, 146.5 A, 117 R

[56] References Cited

U.S. PATENT DOCUMENTS

| | | | |
|---|---|---|---|
| 3,398,730 | 8/1968 | Maddalozzo | 123/139 AP |
| 3,861,225 | 1/1975 | Mattson | 123/117 R |

FOREIGN PATENT DOCUMENTS

| | | | |
|---|---|---|---|
| 831,028 | 4/1938 | France | 123/146.5 A |

*Primary Examiner*—Carroll B. Dority, Jr.
*Assistant Examiner*—Ronald B. Cox
*Attorney, Agent, or Firm*—Flynn & Frishauf

[57] ABSTRACT

The housing of the breaker-distributor is formed with a shaft element inserted in a motor block, and with a flange thereon which is engaged by a claw surrounding the flange and gripping therearound, screwed to the motor to clamp the housing against the motor block. To permit minor adjustment for changes of relative position of the distributor and the motor block upon tightening of the clamping bolt, the attachment shaft is formed with adjustment means acting thereon to permit slight relative displacement of the shaft with respect to the motor block; these adjustment means may, for example, be a hexagonal engagement surface for connection to a wrench, preferably with tapering end faces so that upon rotary engagement of the wrench, simultaneously, a lifting force will be generated; or by forming the claw with threaded holes through which bolts are threaded, engaging the distributor housing eccentrically to exert pressure thereon and effect rotation about the shaft. Upon tightening of both bolts, the relative rotary position will be fixed.

10 Claims, 5 Drawing Figures

INTERNAL COMBUSTION ENGINE DISTRIBUTOR-BREAKER UNIT HOLDING AND ADJUSTMENT ARRANGEMENT

Cross reference to related application: U.S. Ser. No. 669,836 filed, Mar. 24, 1976 (claiming priority of German assigned to the assignee of the present application.

The present invention relates to a distributor-breaker combination, hereinafter referred to briefly as "distributor", for internal combustion engines, and more particularly to an arrangement to secure the distributor to the motor block of the engine to effect reliable attachment thereto while allowing small adjustments to permit accurate adjustment of ignition timing even after the distributor has been assembled on the motor block.

Distributors must be accurately located with respect to the motor block so that the angular position thereof is accurately fixed, since the angular position of mounting of the distributor determines the timing of the ignition instant with respect to the position of the pistons in the engine. It has previously been proposed to secure distributors on the motor block by means of a clamping element, for example a claw or the like which overlaps, in part, the distributor housing. The claw can be clampled to the engine block by a bolt which, upon tightening, clamps the distributor in frictional engagement with a mounting surface on the block.

The claw is tightened by a bolt. Upon rotation of the bolt, it is practically unavoidable that the distributor, that is the clamped element, is also subjected to some change or shift in position with respect to the motor block. Any predetermined timing is thereby slightly changed. The change is not much, but it is nevertheless undesirable. Shift in ignition timing due to external connection of the distributor can be compensated by adjustments within the distributor. These fine adjustments can be effected usually, however, only with the distributor cap removed, and with the motor stopped. This fine adjustment thus must be carried out by trial-and-error method, each time involving disassembly and re-assembly of the distributor cap; this is comparatively time-consuming and is particularly undesirable in serial mass production of vehicles.

It is an object of the present invention to provide a distributor mounting arrangement in which fine adjustment can be easily carried out by simple, readily available tools; the time to effect adjustment should be short.

Subject matter of the present invention: Briefly, the housing is so arranged that slight rotation thereof with respect to the motor block can be effected even when the motor is running. To this end, for example, the distributor is held by a flange engaged by a claw, the claw pressing down the flange against the motor block with such a force that tight frictional engagement results between the motor block and the distributor. The engagement force is so adjusted that the distributor will not change its position with respect to the motor block even under the most unfavorable operating conditions, including continuous vibration, excessive shocks, temperature changes and the like. In accordance with the invention, the housing is so arranged that it can accept a substantially high torque force which overrides the frictional engagement force of the housing with respect to the motor and permits slight angular adjustment thereof with respect to the motor without loosening the claw or similar clamping element which holds the housing in position against the motor.

In accordance with a feature of the invention, the housing is formed with at least two essentially parallel engagement surfaces, preferably six hexagonally arranged engagement surfaces, which accept an open-end wrench. Fine adjustment can easily be carried out thereby in view of the leverage available by use of the end wrench. Preferably, the engagement surfaces on the housing to be engaged by the wrench taper slightly in the direction of the distributor, that is, away from the motor block so that, upon rotation of the distributor, an axial force will be generated directed away from or counter the clamping force of the claw, and pressing the head end of the wrench against the distributor. This facilitates slight rotation. A flange formed at the lower end of the engagement surfaces prevents slippng off of the operating wrench.

In accordance with another feature of the invention, an adjustment arrangement is provided which is located symmetrically with respect to the plane of rotation, that is, the plane for rotary adjustment, formed for example as threads on the claw.

The invention will be described by way of example with reference to the accompanying drawings, wherein.

Figure 1:
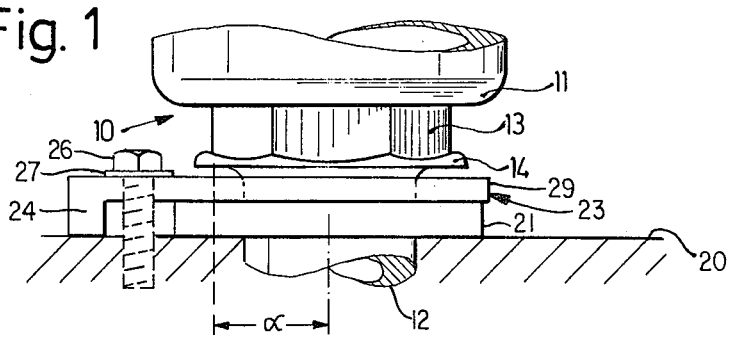
FIG. 1 is a fragmentary perspective view of a portion of the distributor housing and its insertion shaft, with a hexagonal adjustment surface.

The distributor 10 (FIG. 1) has a housing 11 with a flat bottom to which a shaft 12 is attached. The shaft 12 fits into a complementary bore in the enging block, or into some other attachment element on the engine with which it is to cooperate. Shaft 12 is hollow to accept the distributor rotor drive shaft.

Connecting shaft 12 and the bottom of housing 11 of the distributor are hexagonally arranged engagement surfaces to fit a standard open-end wrench. The hexagonal engagement surfaces 13 are essentially parallel to each other, but not quite; they taper slightly upwardly towards the bottom of housing 11, as indicated schematically by the extension lines of the edges of the surfaces, to form an angle $\alpha$ with respect to the central axis of shaft 12. This angle $\alpha$ is small, in the order of 2–5°. A bead or flange 14 is located beneath the hexagonal arranged surfaces 13 to provide a protective surface with respect to shaft 12 and to ensure proper seating of a wrench applied to surfaces 13.

The shaft 12 can be held in the motor block in any desired and convenient manner; one particularly good arrangement is by means of a claw which bears against a flange secured to or formed on shaft 12 and which clamps the flange on shaft 12 against a matching seating surface formed on the engine block. This flange could be arranged, for example, beneath flange 14 of FIG. 1, and spaced therefrom to permit acceptance of the claw.

Figure 2:
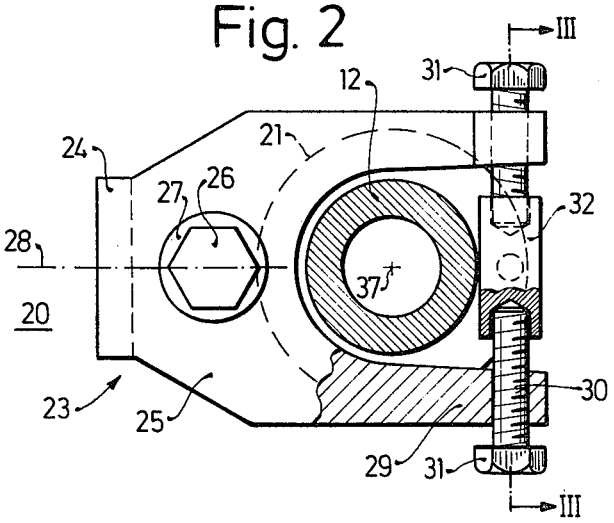
FIGS. 2 and 3 are top and side views, respectively, of another embodiment, FIG. 3 being a section along lines III—III of FIG. 2.
Figure 3:
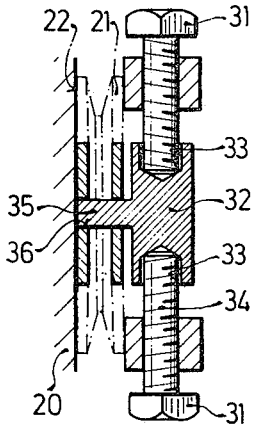

Referring to FIGS. 2 and 3: An engagement surface formed on the motor block 20 is formed with an opening into which the shaft 12 of the distributor fits. Shaft 12 has a flange 21 secured thereto, for example in form of a wheel or pulley. Flange 21 is formed with an engagement surface 22 which matches and fits on the engagement surface of motor block 20. A claw 23 which, in side view, is L-shaped, has a depending bearing portion 24 and a pair of forked end portions 29, engaging around the shaft 12 - with clearance - and bearing against the top surface of flange 21. The claw 23, the abutment portion 24 of which is angled at an approximately right angle, is secured by means of a bolt 26 and an underlying washer in a matching tapped bore of the motor block 20.

The arrangement permits rapid and simple replacement of the distributor by merely removing the claw 23 by unscrewing bolt 26; likewise, replacement of the distributor by a new unit, upon insertion of shaft 12 in the matching bore, is simple; the claw 23 is fitted, as shown in FIG. 2, and bolt 26 tightened. In spite of precautions taken to prevent rotation of the distributor once it has been seated and adjusted, it is practically impossible to tighten bolt 26 without affecting, somewhat at least, the rotational adjustment of the distributor.

In accordance with the present invention, the claw 23 is so arranged that fine adjustment of the rotary position of the distributor is still possible, even though the top plate 25 of the claw has been tightened by tightening bolt 26. The top plate 25 surrounds the distributor in fork shape. The end portions 29 of the top plate 25 are tapped as seen at 30 to accept bolts 31 therein. The two end portions 29 are symmetrical with respect to the plane of rotation 28 of the distributor. A center element 32 is also symmetrically located with respect to plane 28. It is, essentially, a block or sleeve with open bores 33 at its opposite ends. The diameters of bores 33 are slightly greater than the outer diameter of the threaded portions 34 of bolts 31. A pin 35 extends from the block 32 perpendicularly to the blind bores 33. The pin is located in the plane of rotation 28 of the distributor. Pin 35 engages in a hole 36 formed in the flange 21 which is part of the distributor.

Adjustment of the distributor — Operation: After insertion of the distributor, and initial timing alignment, claw 23 is tightened by bolt 26 to thereby seat the distributor on the motor block 20. Bolts 31 are screwed into the tapped holes 30, loosely, until they both seat at the interior of the blind bores 33 of the centering block 32. If fine adjustment requires, for example, rotation of the housing of the distributor slightly in clockwise direction, then the lower one of screws 31 (FIGS. 2, 3) is slightly loosened, and the upper one of the screws 31 is tightened in its threaded hole 30. The upper one of the screws 31 will act as a pressure element, supported at its end at the upper end fork 29 of the top plate 25 of claw 23, and will move the adjustment block 32 downwardly, that is, in clockwise direction. Pin 35 which engages flange 21 eccentrically with respect to the axis of rotation 37 — see FIG. 2 — will rotate the flange 21. The diameter of the blind bores 33 should be so much greater than the outer diameter of the threads 34 on bolts 31 to permit for the slight additional radially inward movement. The force required to be exerted by the screw 31 which bears in the blind bore 33 of block 32 must be greater than the frictional engagement between force flange 21 and claw 23 and motor block 20. Due to the leverage arrangement, however, this additional force can be provided. After the fine adjustment is completed, the previously loosened lower one of screws 31 is seated in the inside of the blind bore 33 so that block 32 is held immovably, thus additionally securing the adjusted position of the distributor.

Figure 4:
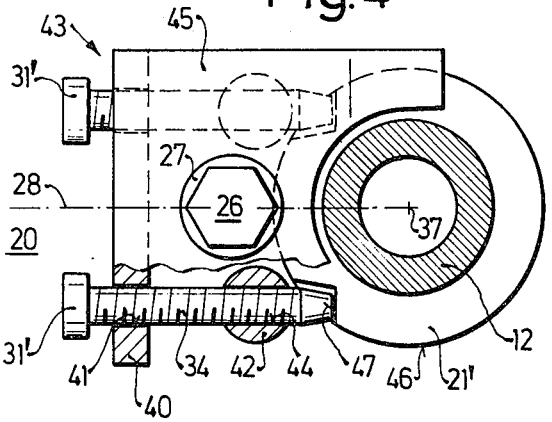
FIGS. 4 and 5 are top and side views of yet another embodiment, FIG. 4 being shown partly in section and FIG. 5 in side view.
Figure 5:
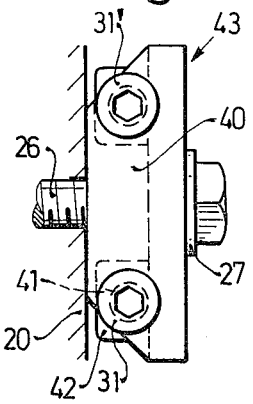

The arrangement of FIGS. 4 and 5 is somewhat similar, except that the adjustment by eccentrically acting screws is arranged to directly engage flange 21'. Similar parts, acting similarly, have been given the same reference numerals, and essentially identical parts the same reference numerals with prime notation. The L-shaped claw 43 is formed with a forked top plate 45 and an engagement abutment 40 engaging motor block 20. Screw 26 holds claw 43 to the motor block by engaging the top plate 45. The claw 43 is symmetrical with respect to the plane of rotation 28 of the distributor. The depending portion 40 of the L-shaped claw is formed with an opening 41 for insertion of respective adjustment screws 31'. The flange 21' is formed with a notched circumference 46, to provide a pair of symmetrically arranged engagement surfaces 47 against which bolts 31' can bear. Bolts 31' are tapped to have threads 34' formed thereon. The threads 34' are tapped into matching tapped holes 44 located in depending stubs 42, projecting downwardly from the top plate 45 of claw 43. The stubs may be rotatable with respect to top plate 45, or may be integral therewith. The engagement surfaces 47 for bolts 31' are eccentric with respect to the axis of rotation 37 of the distributor as well as with respect to the plane of rotation 28. As in the embodiment of FIGS. 2 and 3, the forces applied by the bolts act eccentrically, that is, they provide a moment to the flange 21, 21' of the distributor, and hence to the shaft 12 and to the distributor as a whole.

Adjustment and operation: In principle, the adjustment is similar to that explained in connection with FIGS. 2 and 3. One of the bolts 31' must be loosened, and the other bolt 31 tightened against the respective engagement surface 47. Eccentric force is thus applied to the plate 21' to rotate the plate against the frictional forces provided by the clamping claw 43. After the distributor is located in position, the previously loosened bolt 31 is engaged with the respective engagement surface to fix the adjusted position of the distributor and prevent spurious angular change thereof.

Various changes and modifications may be made, and features described in connection with any one of the embodiments may be used with any one of the others, within the scope of the inventive concept.

I claim:

1. Internal combustion engine distributor holding and adjusting arrangement, to secure a distributor (10) in adjusted position on the motor block (20) of the engine, having a housing (11), a shaft (12) for insertion in the motor block (20) of the engine, means (21, 23) secured to the motor block (20) and engaging the distributor (10) to clamp the distributor to the motor block (20) including a releasable bolt (26) to tighten the distributor into frictional engagement with the block;

and a unitary boss concentric with said shaft (12) and formed with essentially parallel engagement surfaces to permit engagement therewith by a wrench located below the bottom of the housing (11) of the distributor and forming a thickened portion of said shaft (12) the engagement surfaces tapering slightly in the direction of the bottom of the housing (11) so that, upon application of rotary force to said engagement surfaces, a lifting force component will result to permit slight relative rotary movement between the shaft, and hence the distributor, and the motor block after said clamping means have clamped the distributor against the motor block to permit fine adjustment of ignition timing of the engine.

2. Arrangement according to claim 1, wherein the angle of taper of the engagement surfaces (13) is in the order of b 2–5°.

3. Arrangement according to claim 1 wherein the means (21, 23) secured to the motor block and engaging the distributor comprise a fork-shaped claw (23) with an opening between the fork ends (29) engaging around the shaft (12) of the distributor;

and a flange (21) secured to the housing and having a surface seating against a matching surface on the engine block, the claw engaging around the shaft and over the flange.

4. Arrangement according to claim 1, further comprising a bead or flange (14) formed on said boss and beneath said engagement surfaces, spaced from the bottom of the housing (11), the bead or flange forming a terminating surface of said boss with respect to the shaft (12).

5. Arrangement according to claim 1, wherein said engagement surfaces (13) formed on the boss are hexagonally arranged with respect to each other.

6. Internal combustion engine distributor holding and adjusting arrangement, to secure a distributor (10) in adjusted position on the motor block (20) of the engine, having a housing (11), a shaft (12) for insertion in the motor block (20) of the engine, a fork-shaped claw (23, 43) with an opening between the fork ends (29) engaging around the shaft (12) of the distributor, the claw being secured to the motor block (20) and engaging the distributor (10) to clamp the distributor to the motor block (20) including a releasable bolt (26) to tighten the distributor into frictional engagement with the block;

and adjustment means (13, 35, 36, 47) acting on the shaft (12) of the distributor and permitting slight relative rotary movement between the shaft, and hence the distributor, and the motor block after said clamping means have clamped the distributor against the motor block to permit fine adjustment of ignition timing of the engine, said adjustment means comprising a pair of screws (31, 31′), a pair of threaded means (30, 42) on the claw located, respectively, symmetrically with respect to the plane of rotation of the distributor shaft and the plane of symmetry of the end portions (29), the screws (31) being located in said end portions and engaging the distributor eccentrically with respect to the center of the shaft and symmetrically with respect to each side of said plane of symmetry to rotatably adjust the distributor upon rotation of one of the screws in the thread means, and to lock the distributor in adjusted position upon engagement of the other of said screws with the distributor.

7. Arrangement according to claim 6 wherein the means (21, 23) secured to the motor block and engaging the distributor comprise a fork-shaped claw (23) with an opening between the fork ends (29) engaging around the shaft (12) of the distributor;

and a flange (21) secured to the housing and having a surface seating against a matching surface on the engine block, the claw engaging around the shaft and over the flange.

8. Arrangement according to claim 6, wherein (FIGS. 4 and 5) the claw is generally L-shaped and has an abutment portion (40) engaging the motor block (20) of the engine and a plate portion (45) formed with said fork ends, the screws (31′) passing through the abutment portion of the claw symmetrically with respect to said plane of symmetry;

and engagement surfaces (47) located eccentrically with respect to the axis of rotation of the distributor and located in alignment with said screw (31′).

9. Arrangement according to claim 6, wherein (FIGS. 2 and 3) the fork-shaped end portions (29) of the claw (23) are formed with facing, aligned, tapped bores (30), the bolts (12) being threaded into said bores;

and an adjustment block (32) is located between said bolts and held thereby, the adjustment block (32) being formed with means (35) eccentrically engaging a portion (21) of the housing.

10. Arrangement according to claim 6, wherein the housing is formed with a flange (21) having a surface seating against a matching surface on the engine block, the claw engaging around the shaft and over the flange;

said flange being formed with an eccentric opening (26) and the adjustment block (32) being formed with a pin (35) engaging the eccentric opening, the adjustment block being additionally formed with aligned blind bores (33) located to receive the screws (31).

* * * * *